US005469772A

United States Patent [19]

Vandervoort

[11] Patent Number: 5,469,772

[45] Date of Patent: Nov. 28, 1995

[54] LINEARLY RECIPROCATING KEYBOARD KEY INCORPORATING TWO GUIDE PINS

[76] Inventor: Paul B. Vandervoort, 2875 Idlewild Dr., #19, Reno, Nev. 89509

[21] Appl. No.: 40,209

[22] Filed: Apr. 1, 1993

[51] Int. Cl.[6] ..... G10C 3/12

[52] U.S. Cl. ..... 84/436

[58] Field of Search ..... 84/644, 620, 744, 84/745, 423 R, DIG. 7, 433–436

[56] References Cited

U.S. PATENT DOCUMENTS

| | | | |
|---|---|---|---|
| 360,255 | 3/1887 | Von Janko . | |
| 2,675,728 | 4/1954 | Jewett | 84/424 |
| 2,675,729 | 4/1954 | Jewett | 84/424 |
| 3,468,209 | 9/1969 | Barreto | 84/423 |
| 3,478,857 | 11/1969 | Linker . | |
| 3,738,216 | 6/1973 | Slaats et al. | 84/433 |
| 3,757,068 | 9/1973 | Musch et al. | 200/159 R |
| 3,859,885 | 1/1975 | Hayashida | 84/251 |
| 4,464,325 | 8/1984 | Kondo et al. | 264/229 |
| 4,476,769 | 10/1984 | Kumano | 84/434 |
| 4,626,639 | 12/1986 | Bradford | 200/340 |
| 4,827,243 | 5/1989 | Cheng | 341/22 |
| 5,185,490 | 2/1993 | Vandervoort | 84/436 |

FOREIGN PATENT DOCUMENTS

| | | | |
|---|---|---|---|
| 857729 | 12/1952 | Germany | 84/423 |
| 2154947 | 9/1985 | United Kingdom | 400/496 |

*Primary Examiner*—William M. Shoop, Jr.
*Assistant Examiner*—Jeffrey W. Donels

[57] ABSTRACT

A keyboard for use in a musical instrument or other application includes a key incorporating two guide pins extending downward from directly underneath the key. The front guide pin passes through two bushings, the rear guide pin passes through one bushing. Various preferred embodiments are disclosed including: Application to a Janko musical keyboard with independent keys and MIDI functions; A combination return spring and motion sensor; a swing arm return spring and contact spring mechanism; and a method of bundling together multiple frame members to hold multiple key rows with enhanced rigidity.

15 Claims, 4 Drawing Sheets

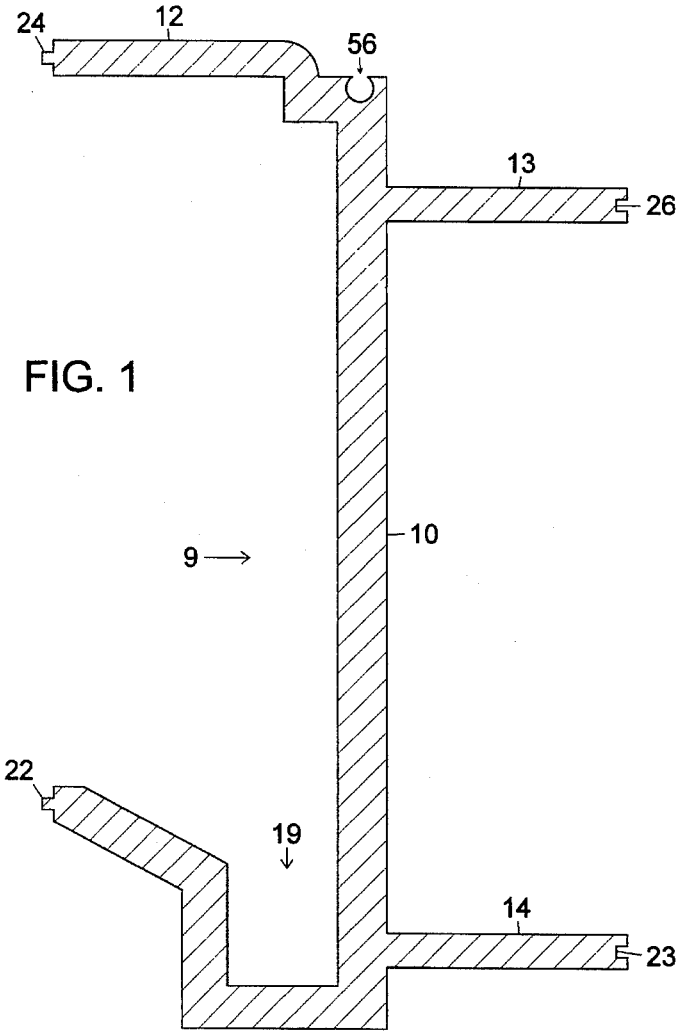
FIG. 1
FIG. 3A
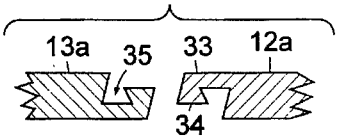
FIG. 3B
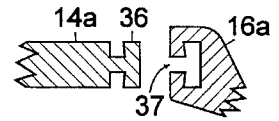
FIG. 2
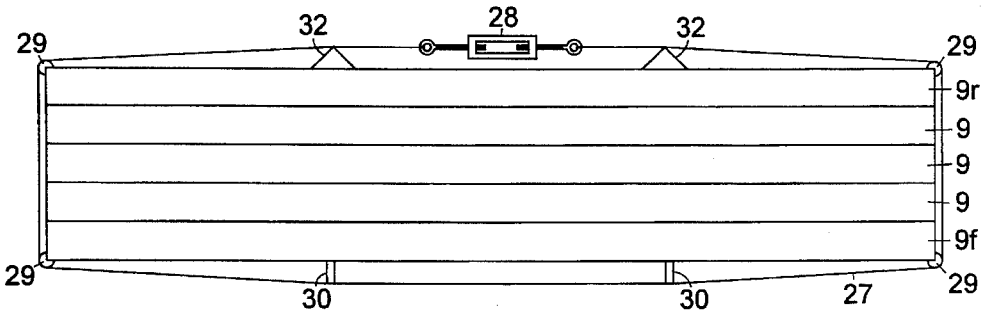

LINEARLY RECIPROCATING KEYBOARD KEY INCORPORATING TWO GUIDE PINS

FIELD OF THE INVENTION

This invention relates to a keyboard in a musical instrument, word processor or other finger-operated device wherein a key is reciprocated along a linear axis of motion by the finger of the operator. Generally, this axis is roughly vertical, but may be horizontal in certain applications, such as an accordion.

BACKGROUND OF THE INVENTION

In the applicant's prior U.S. Pat. No. 5,185,490 a key structure is shown in FIG. 15. This key structure is intended mainly for a terraced keyboard, e.g., a Janko Keyboard. A modification of this structure is suggested in column 17, line 28. In both the shown structure and the suggested modification the two-bushing pin is in the rear and the underside of the key adjacent the two pins is the same elevation, i.e., it is the same distance from the key top. This arrangement has been found to be less than ideal for several reasons:

Wobble is greater than it can be since either the front pin is positioned to the rear of the guard flange (and closer to the rear pin) or the underside of the key adjacent the rear pin is extended downward to the same elevation as the bottom of the guard flange (thus, extending the rear bushing downward as well). To minimize wobble, it is desirable to place the two pins as far from each other as possible, and also to place the bushings as close to the key top as possible. These placements will also serve to minimize bushing friction and wear by minimizing the leverage with which side force placed on the key is transmitted to the bushings.

Also, placing the two-bushing pin at the rear has been found to be less than ideal. Stress analysis has shown that a greater cross-sectional area (diameter) is required for the two-bushing pin than for the one-bushing pin. (This difference in pin requirements is discussed further in the description of the preferred embodiment below.) To minimize the amount of material used to make the pins, the two-bushing pin will thus be thicker than the one-bushing pin. The one-bushing pin therefore requires less length embedded in the key than the two-bushing pin to guarantee against being pryed out of the key by extreme side force. Thus, in this respect, the prior art embodiment with no guard flange is preferred (since the two-bushing pin can be imbedded deeper into the key), but, as stated earlier, friction and wobble are increased in this embodiment.

Another difficulty found with the guard flange embodiment: In order to provide plenty of clearance between the guard flange and the front bushing, the front pin must be placed significantly to the rear of the guard flange. This places the two pins even closer together which, as stated earlier, is not desirable.

Also, reducing the design as shown to practice has proven to be more difficult than expected. Specifically, it is necessary that the keyboard may be easily disassembled for repair. It is also necessary that the frame holding the bushings is rigid so the keyboard has a solid feel. If the frame for all key rows were formed as a single aluminum extrusion, it could be made quite rigid. But this might make access to the various mechanisms (return spring, key motion sensors, bushings, etc.) difficult.

One solution is to place the return springs and motion sensors under the frame. However, this would increase the height of the overall key mechanism, which is already somewhat high due to the necessary length of the two-bushing guide pin.

The key rows may be mounted on discrete key frame rails, (extruded separately), but these rails would tend to be less rigid than a single extrusion. Large amounts of aluminum could be used in each extrusion to add rigidity, but this would also add cost and weight. Thus, another means must be found to reinforce individual rails.

The applicant conceived the idea of connecting the rails together so they could reinforce each other. However, with the two bushings of each key at the same elevation, the upper front bushings of one row are at a higher elevation than the rear bushings of the adjacent row in front. It has been found that this non-alignment of the adjacent bushings makes it very difficult to connect the rails together without sacrificing other desired qualities. The most practical way found by the applicant for providing discrete rails has required a departure from the prior art.

OBJECTS OF THE INVENTION

The objects of the present invention include:

(a) to provide a key with minimal friction;

(b) to provide a key with minimal wobble;

(c) to provide a key with wear-resistant bushings;

(d) to provide a key with quiet action;

(e) to provide a key which can withstand extreme side force resulting from accidental impact with foreign objects or from aggressive performance technique;

(f) to provide a key which can withstand extreme downward force resulting from accidental impact with foreign objects or from aggressive performance technique;

(g) to provide a key with significant mass and, thereby, a satisfying "weighted action" key touch;

(h) to provide a keyboard with a rigid key frame;

(i) to provide a keyboard which can be easily assembled, disassembled, and repaired;

(j) to provide a keyboard which can be manufactured at low cost.

SUMMARY OF THE INVENTION

Accordingly, the present invention provides a key with a front guide pin and a rear guide pin. The pins are parallel and extend downward directly from the underside of the key. The front guide pin is positioned forward of the key center; the rear guide pin is positioned to the rear. The guide pins may be formed of nickel-plated steel, as recommended, or other material, with their top ends embedded in the key. Alternately, the pins may be formed with the key as a unitary structure of the same material. The front guide pin mates with two bushings. The rear guide pin mates with one bushing. The bushings are incorporated in a frame member.

The invention may be utilized to achieve the objects stated above in a terraced or unterraced keyboard.

With the single-bushing pin in the rear, the depth of this pin in the key may be low, as explained above. Thus, the key may be short at the rear and the rear bushing may be placed close to the key top. For a terraced keyboard, the guard flange of the prior art key may be expanded rearward and the front pin may extend downward from the underside of this expanded guard flange. Thus, the underside surface of the key adjacent the front guide pin is lower than the underside surface of the key adjacent the rear guide pin. The two-bushing pin may be embedded deeply in the key and the distance between the two pins may be maximized.

To provide for solid engagement of multiple key frame rails with each other, the rear bushing is the same elevation as the upper front bushing of the key adjacent to the rear. Thus, the frame flanges which hold the bushings may also be used to connect the frame rails to each other. A minimum of frame material may be used, a minimum of holes may be drilled (or punched), and the rear bushings may be placed in close proximity to the adjacent upper front bushings of the next higher key row, thus allowing maximum distance between front and rear pins within each key.

In the preferred embodiment all keys on the keyboard are substantially identical (except for the key top coloring and the tactile orientation system). With these identical keys and the rear bushings vertically aligned with the adjacent upper front bushings (as stated above), the elevation difference between the upper front bushing and the rear bushing of the same row is equal to the elevation difference between key tops of adjacent rows.

ORIENTATION TERMS AND DISCLAIMER

In this specification and appended claims orientation terms are based on the orientation of a musician as most commonly positioned at a piano keyboard; thus:

The longitudinal axis is that which extends from the left, or bass end of the keyboard to the right, or treble end.

The lateral axis is that which extends from the front to the rear of the keyboard.

The vertical axis refers to the key axis of motion. Thus, the guide pins of the present invention are considered vertical. The key surface normally depressed by the finger of the operator during operation is referred to as the key "top" and is considered to be at a higher elevation than the opposite ends of the guide pins.

These orientation terms are intended only to convey the placement of the various parts and elements in relation to each other and to facilitate description and understanding of various parts, elements and events. They are not intended to convey any limitation on the placement of the keyboard in relation to the direction of gravitational force or to the physical orientation of the operator. The invention and the preferred embodiment, properly engineered, may be tilted on any horizontal axis to any angle or upside down during or after assembly and still be made to operate without detriment to performance. An example of an alternative angle application is an accordion.

BRIEF DESCRIPTION OF THE DRAWING FIGURES

FIG. 1 is a cross-sectional view of a frame member which supports one row of keys.

FIG. 2 is an overhead view of an assembled keyboard frame.

FIG. 3 is a cross-sectional side view of two pairs of interlocking frame members in an alternate to the embodiment shown in FIGS. 1, 2, 4, & 5.

BACKGROUND AND OBJECTS OF THE PREFERRED EMBODIMENT

Figure 4:
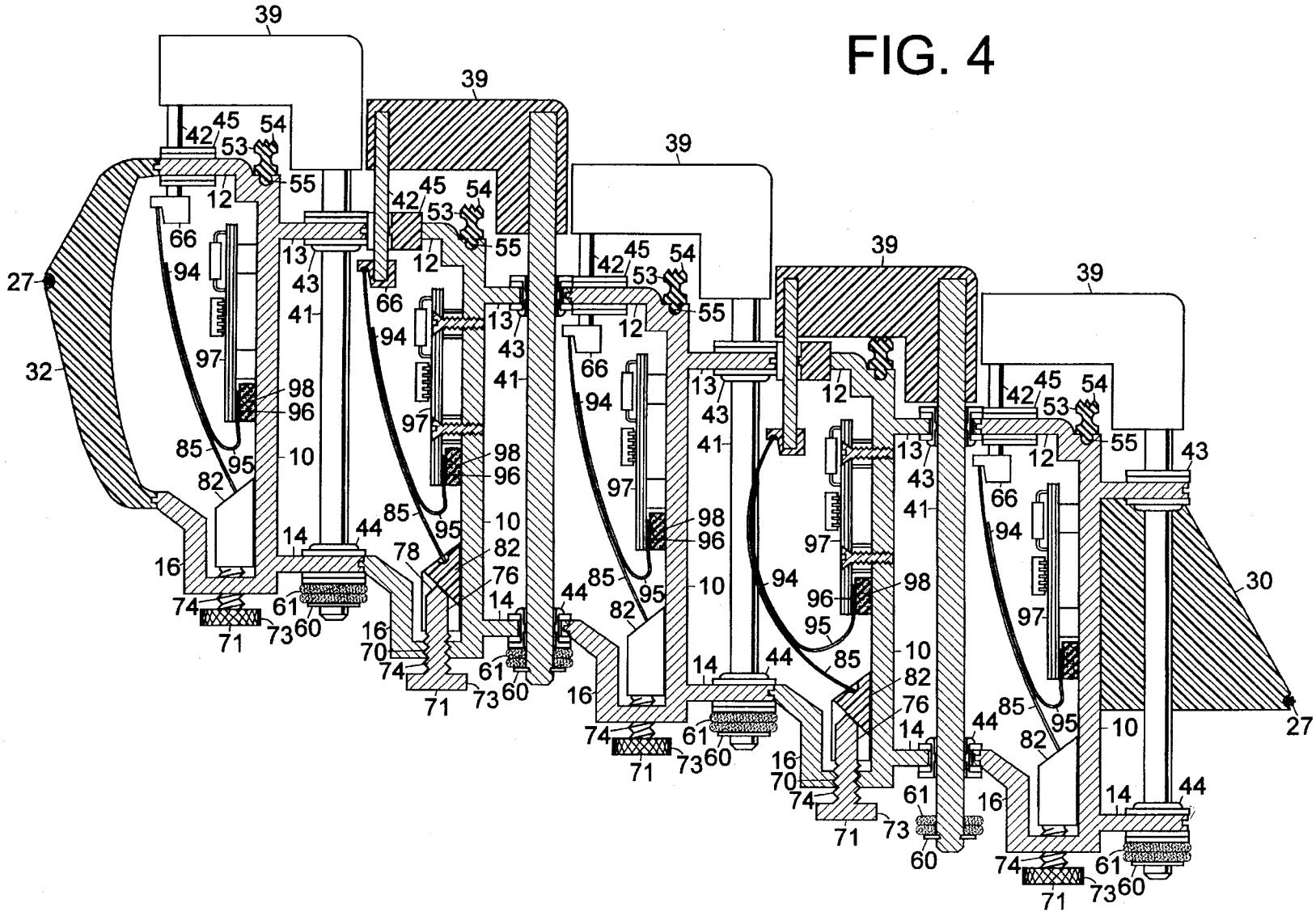
FIG. 4 is a diagrammatic sectional view of a musical keyboard comprising multiple rows of independent keys. The view is from left, or bass, end of the keyboard.

The preferred embodiment of the present invention relates to the Janko musical keyboard. This keyboard is described in U.S. Pat. No. 360,255 (Von Janko) and others.

The conventional Janko Keyboard comprises six whole-tone key rows. It has been found that learning one's way around six rows is conceptually difficult. Five rows suffice for the comfortable performance of almost any piece of music. Thus, the preferred embodiment consists of five whole-tone key rows. The assignment of whole-tone scales to the five rows is arbitrary. With versatile software as described below, scales may be assigned at the user's discretion. However, in the interest of standardization, it is recommended that the whole-tone scale including the note C be assigned to rows 1, 3, and 5. This is the assignment used by the Rapian Keyboard, manufactured by the RARA co. of Japan.

On the Janko Keyboard, three keys are assigned to each note. In this specification, these three keys are referred to as a key set. Traditionally, key sets have been connected into a single assembly; when one key is depressed, the other two move downward as well. In the five-row keyboard herein described, half the key sets consist of two keys (keys within the second and fourth rows) and all keys move independently.

Numerous advantages are offered by this arrangement, including the following:

Manufacturing costs may be reduced.

Equal dip for each row of keys may be easily engineered at low manufacturing cost and without the key support mechanism extending rearward beyond the rear row of keys.

With no key support mechanism rearward of the rear row, buttons, ribbons, wheels or other controllers can easily be mounted in close proximity to the keyboard—allowing easy reach of the fingertips and compact size (small depth) of the keyboard case.

With independent key motion sensing means for each key coupled to a computer processor, the keyboard may become a highly versatile MIDI controller. Numerous special functions and features may be realized through software programming. The following is a description of the preferred means of configuring the keyboard via software and some of the special functions/features which this configuration permits.

The keyboard is split into zones, e.g., the notes in all five rows between middle C and A440 may be defined as zone #3. As another option, one zone may include the entire keyboard. A zone may be selected to operate in one of five modes—Basic Sustain, Basic Repetition, Sub-Zones Repetition, Sub-Zones Independent and Patch Control.

All keys in a Basic Sustain or Basic Repetition zone transmit on the same MIDI channel(s) and keys within a key set play the same note. Basic Sustain mode is selected if the musician wishes a zone to operate as a conventional Janko. In this mode, keys within a key set also sustain each other, e.g., the musician may strike and hold a note in row 3 with the index finger while striking the same note in row 1 with the thumb. The second strike does not produce a second attack, since the index finger is held down; but after the second strike, the index finger may release and the note can still be sustained by the thumb.

This can be accomplished in MIDI as follows: The keyboard computer incorporates a memory device. The memory device stores data packets called event records.

An event record specifies a note and a MIDI channel. The memory device can store up to three identical event records at once. Any time a key is struck, the memory is scanned for event records corresponding to the note and MIDI channel which that key is programmed to transmit. If (and only if) no corresponding event record is found, a "note on" command is transmitted. Then an event record for that note is recorded in memory. Any time a key is released, an event record for that note is erased. Then the memory is scanned. If no corresponding event record is found, a "note off" command is transmitted.

Basic Repetition mode allows fast repetitions of one or more notes (via alternate strikings of two or three keys corresponding to the same note). This mode operates as follows: As a key is struck, a "note off" command is transmitted. This is followed by a "note on" command. Then an event record is recorded. The computer processes the release stroke as in Sustain mode. In Basic Repetition mode fingers within the same hand may play note repetitions or one hand may be placed over the other, playing the same note or chord on higher rows. Thus, chords or notes can be repeated with rapidity and fluidity.

In the two Basic modes, key sets may be re-mapped, e.g., octaves can be shifted or alternate note layouts can be programmed. Thus, another, more comfortable way to perform two-handed repetitions is to program two Basic Repetition zones to play the same notes in the same channel. With this configuration, the two hands do not have to overlap.

Basic Repetition and Basic Sustain modes can be flip-flopped during performance with a panel switch, foot switch or other controller. One zone may operate in repetition mode and another in sustain mode.

A zone may be subdivided into Sub-Zones as well. A Sub-Zone is defined here as a key row within a zone. Five Sub-Zones are thus possible within each zone. A Sub-Zone may be assigned to any MIDI channel(s). Each key within a Sub-Zone may be independently programmed to play any note and any microtonal offset.

Sub-Zones Repetition mode allows fast repetitions of notes within a key set as in Basic Repetition mode. This mode operates as follows: As a key is struck, a "note off" command is transmitted for the note/channel corresponding to the key being struck as well as the note(s)/channel(s) corresponding to each key in the same set as the key being struck. This is followed by a "note on" command. Then an event record is recorded. The computer processes the release stroke as in Sustain mode.

One nice effect which can be accomplished in this configuration utilizes a sampler. The sampler is programmed to play samples of a guitar chord being strummed. One octave of the sampler contains samples of chords being stroked downward. Another octave contains samples of upward strokes of the same chords. Chords correspond with notes, e.g., a "note on" command for middle C triggers a C chord. The lowest two rows of the keyboard trigger the downstroke samples. The third and fourth rows trigger the upstroke samples. With velocity sensitivity, some strokes can be accented or played softly. Thus, with the thumb and index finger of one hand, a keyboard player may perform a near-perfect duplication of a rhythm guitar in real time.

As an alternative to storing event records in memory, the computer may instead scan the key contacts of the other keys of the same set (or the other keys with which the original key is functionally linked) to see if any are depressed and act accordingly.

In Sub-Zones Independent mode, each key within a Sub-Zone triggers and mutes independently. This mode is useful for alternate note layouts or keyboard mapping. For example, each key set may contain different octaves of the same note. A row of keys may be programmed to whatever scale is desired, e.g., a row may be tuned chromatically, so that chromatic glissandos may be easily performed. This mode is also useful for controlling drum machines, special effects, or for microtonal tunings. A 30-tone per octave tuning scheme may be easily accommodated.

In Patch Control mode each key within the zone is dedicated to the function of calling up a keyboard configuration patch.

Another aspect of the preferred embodiment concerns key return means, e.g., return springs, and key motion sensing means. In musical keyboards these mechanisms are typically distinct from each other. In engineering a Janko Keyboard with independent keys, however, one finds that space underneath the keys is at a premium. There is little room for the necessary mechanisms. Thus, consolidation of key return means and motion sensing means is particularly valuable in this situation. An ideal consolidation of these two mechanisms would retain the desirable features associated with these functions. Some of these desirable features are discussed below.

It is desirable in some types of keyboards to incorporate a key return mechanism which provides downstroke resistance which decreases as the key is depressed. An example of such a keyboard is one incorporating a tactile orientation system, e.g., Braille. The key return means must provide sufficient initial downstroke resistance to allow the operator to feel a tactile feature on a key top without depressing the key. At the same time, however, it is desirable to minimize the overall energy, i.e., force through distance, which is required to fully depress the key. Minimizing this overall required energy reduces finger fatigue. To provide optimum initial downstroke resistance while minimizing finger fatigue, downstroke resistance which decreases during key depression in thus required.

Other advantages of decreasing downstroke resistance are discussed in various prior art including U.S. Pat. Nos. 3,478,857 (Linker) and 4,476,769 (Kumano).

Another of the generally desirable characteristics of a keyboard key return mechanism is low manufacturing and assembly cost.

One of the desirable features of a key motion sensing system for a musical keyboard is after-touch. After-touch in this specification is defined as key travel which occurs after the corresponding note is sounded and before the lower-travel-limit means begins to introduce downward movement resistance. (This after-touch is not to be confused with the MIDI functions of release-velocity, channel-pressure or poly-pressure.) It has been found that if a note is sounded as a key completes two-thirds of its travel, a satisfying result is produced. The elapsed time during the last third of key travel roughly corresponds with the time required for the audio sound wave to travel from the sound source (e.g., speaker) to the musician's ear. Thus, an approximate simultaneity occurs between the initial attack component of the audio sound and the physical sensation of the key reaching its lower limit of travel. This simultaneity is generally satisfying to the musician.

PianoDisc Systems of Sacramento, Calif., has developed a key motion sensing system which employs Piezoelectric sensor strips mounted under key levers. This system is described in detail in a U.S. Pat. application filed by Pianodisc in January of 1992. Numerous desirable characteristics are in the PianoDisc system. These characteristics include low wear, low manufacturing and assembly cost, and immunity from airborne particle contamination.

However, the PianoDisc sensing system, as embodied in the PianoDisc recording strip available for purchase as of 1992, does not lend itself well to consolidation with key return means for at least two reasons:

Firstly, the PianoDisc piezoelectric sensor strips are formed primarily of Mylar. Repeated or continual stress on this material will alter its natural shape at rest and, hence, alter its spring characteristics.

Secondly, the piezoelectric sensing strip under each key imparts a downstroke resistance which increases as the key is depressed. This effect runs counter to the decreasing downstroke resistance feature which is sometimes desirable as set forth above.

Also, the PianoDisc piezoelectric sensing strips produce an output voltage which is roughly proportional to key velocity. Thus, a relatively low output voltage is produced in the initial acceleration part of the key stroke. This low output voltage results in a low signal-to-noise ratio. Consequently, if after-touch is desired, the processing circuit must read voltage when it can do so with the least accuracy and ignore voltage during the last third of key travel, which is when the signal-to-noise ratio is at its best. The PianoDisc sensing system is thus not well suited to provide both accurate key velocity reading and after-touch at the same time.

An objective of the preferred embodiment is to provide a consolidated key return and sensing means which satisfies the desirable characteristics set forth above.

DETAILED DESCRIPTION OF THE PREFERRED EMBODIMENT

Each row of keys is supported by a frame member 9. A cross-sectional view of this frame member is shown in FIG. 1. Each frame member 9 runs the length of the keyboard and may be formed of extruded aluminum. Incorporated in each frame member 9 is a main body portion 10 and three horizontal flanges: an upper rear 12, an upper front 13, and a lower front 14. Each frame member 9 also includes an L-shaped flange 16 extending rearward from the lower area of the main body portion 10. L-shaped flange 16 in combination with the main body portion 10 defines a vertically-facing slot 19 with parallel vertical sides.

L-shaped flange 16 includes a rearwardly-facing edge incorporating a tongue 22 which mates with a groove 23 on a forwardly-facing edge on lower front flange 14 of frame member 9 adjacent to the rear. Upper rear flange 12 also includes a rearward-facing edge incorporating a tongue 24 which mates with a groove 26 on a forward-facing edge on upper front flange 13.

To keep the aforementioned edges mated, a bundling system is provided. This bundling system is shown in FIG. 2, which is an overhead view of five assembled frame members 9 corresponding with five whole-tone key rows. Keys, bottom-limit-of-travel cushioning strips, bushings, and holes for bushings are not shown. A loop of steel cable 27 is provided which horizontally circles the five frame members 9. A turnbuckle 28 is incorporated in the cable loop to tighten the cable. The five frame members are thereby bundled together. A corner bushing 29 is provided at each vertical corner edge of the assembled keyboard. These bushings serve to maintain the cable's vertical position and prevent the cable from digging into the corners of the front and rear frame members. The lateral tension of the installed cable 27 keeps the frame members mated at the left and right ends of the keyboard. Four spacers are also provided. Two front spacers 30 are placed at the front of front frame member **9*f*; and two rear spacers 32 are placed at the rear of rear frame member 9*r***.

These spacers outwardly displace the cable 27 in the center front and rear sections. Tensile force from the cable 27 is thereby utilized to produce lateral compressive force to keep the frame members 9 mated in the middle area of the keyboard. Each spacer pair is positioned horizontally to trisect the overall length of the frame members 9. Spacers 30 and corner bushings 29 may be formed of nylon or similar material.

An alternative method of attaching the frame rails to each other is shown in FIG. 3. This method obviates the need for the cable arrangement shown in FIG. 2. The front flanges are engaged to the corresponding rear flanges via interlocking joints. Upper rear flange **12*a* incorporates a tongue 33 which extends rearward and downward. The downward-extending portion 34 of the tongue is trapezoidal with the base of the trapezoid facing downward. Upper front flange 13*a* incorporates a groove 35 shaped to accommodate upper rear flange tongue downward-extending portion 34 with minimal clearance. Lower front flange 14*a* incorporates a T-shaped tongue 36 which extends forward. L-shaped flange 16*a* incorporates a groove 37 shaped to accommodate T-shaped tongue 36** with minimal clearance. Other interlocking cross-sectional shapes may be used alternately. For assembly, the treble end of one rail is inserted into the bass end of the adjacent rail. With the joints interlocked, the rails are slid relative to each other until they are properly aligned. So the rails may slide easily, and to ensure that the joints don't creak during use, silicone grease is applied to the grooves.

The keys which normally sound notes corresponding to the black keys of a standard keyboard incorporate black tops and white sides. Thus, the coloring pattern is familiar to most musicians, and the cracks between the black keys are clearly visible.

FIG. 4 is a diagrammatic sectional view from the left, or bass, end of the keyboard. Rows 2 & 4 are shown cut-away through the center. The key in row 2 is shown at bottom of stroke. The other four keys are shown in rest position. Each key 39 is supported by a front guide pin 41 and a rear guide pin 42. The top ends of these pins are embedded in the key. The pins move with the key during operation. Guide pins 41 & 42 may be formed of nickel-plated steel. The horizontal distance separating these pins is maximized and the height of the key 39 is minimized. This minimum key height is greater at the front of the key than at the rear, since depression of a key adjacent to the front will expose the key at a lower elevation than depression of a key adjacent to the side. Thus, the front section of the key 39 extends lower that the rear section. Front guide pin 41 is embedded in this front section. The elevation difference between the underside key surfaces of these sections is substantially the same as the elevation difference between key tops of adjacent rows.

Front pin 41 passes through an upper front bushing 43 and a lower front bushing 44. These two front bushings are mounted in corresponding frame flanges 13, 14. Rear pin 42 passes through a single rear bushing 45 which is mounted in upper rear flange 12. Front bushings 43, 44 are made to accommodate 360 degrees of side force. Rear bushing 45 is made to accommodate longitudinal side force only. The rear bushing provides no substantial resistance to lateral side force; thus, binding of the key does not occur.

Figure 5:
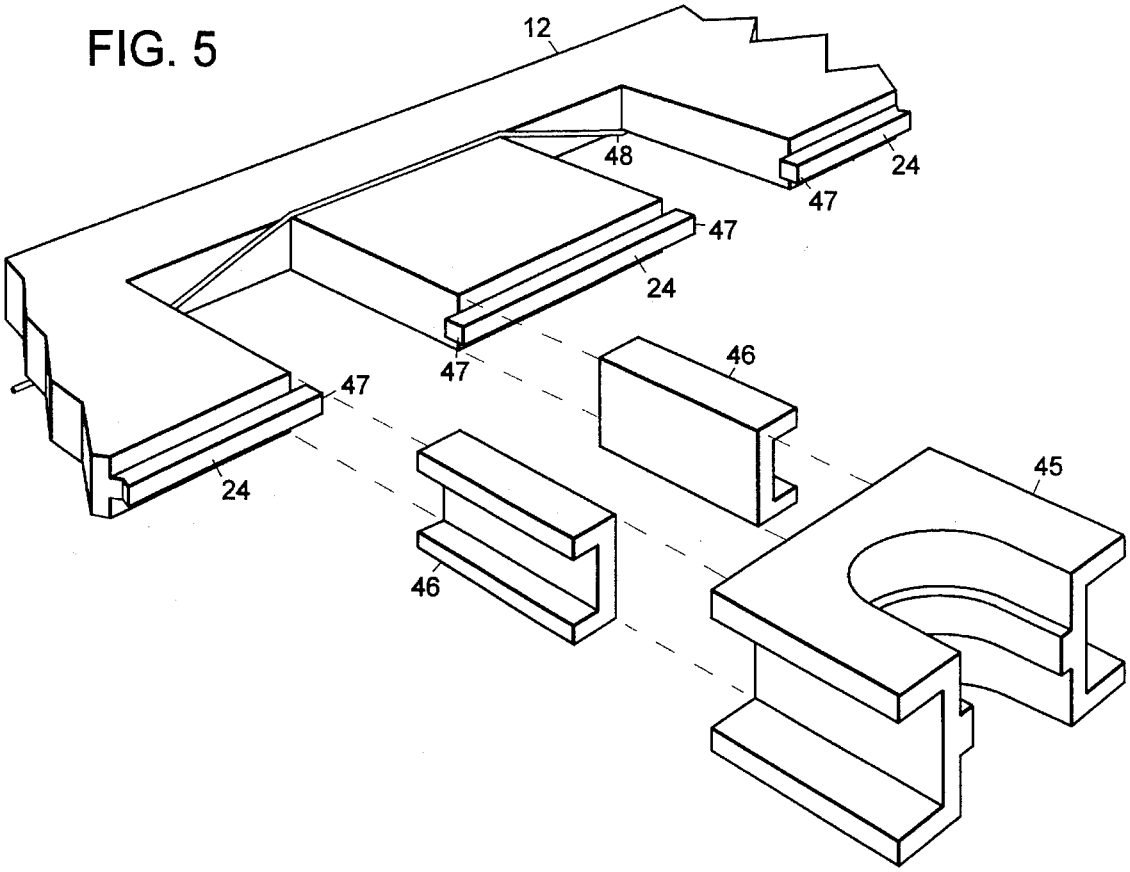
FIG. 5 is a perspective exploded view of an upper rear bushing, bumpers, and frame.
Figure 13:
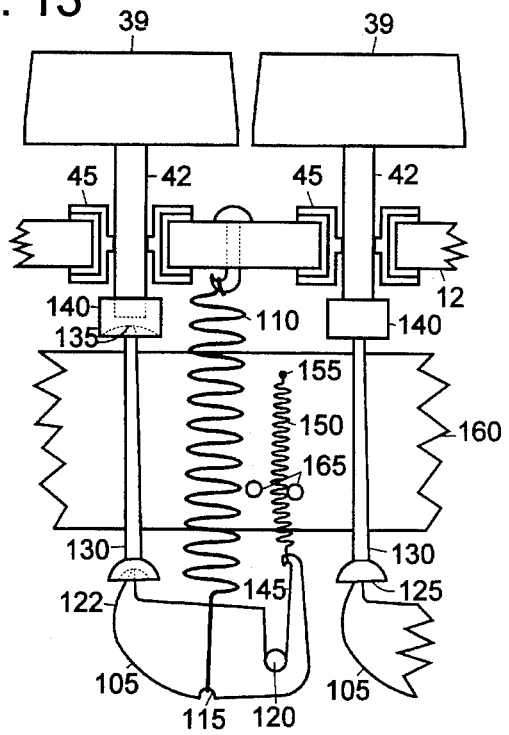
FIG. 13 is a rear view of a keyboard according to to an alternative preferred embodiment.

The bushings may be modeled after ones described in the applicant's prior U.S. Pat. No. 5,185,490. "This patent is incorporated herein by reference.". However, several variations have since been developed which are suggested:

FIG. 5 shows an alternative to the prior rear bumpers. Each rear bushing 45 is cushioned on each side by a channel-shaped rear bumper 46. These rear bumpers may be cut from extruded silicone rubber. Advantages of these bumpers include: lower manufacturing cost than the bumper shown in applicant's prior U.S. Pat. No. 5,185,490, FIG. 14; less deterioration over time than the rubber bands shown in prior Pat. FIG. 11*a* (since the channel-shaped bumpers are not normally under tension); and an area is left exposed on the upper rear flange 12 for overlap of the upper front bumper and bushing flanges of the adjacent row. Also, leaving this area exposed allows easy access to a hole which may be drilled in this area for attachment of a return spring. This return spring is used in an alternate embodiment which is shown in FIG. 13.

To prevent the channel-shaped bumpers 46 of the top key row from sliding rearward off the frame, retaining posts 47 are provided. These posts are longitudinal extentions of the upper rear flange tongue 24 and may be formed as part of the shape of the die which is used to punch out the hole for the rear bumpers and bushing in the upper rear flange 12. The longitudinal distance which these posts extend is equal to or less than the longitudinal thickness of an installed upper rear bumper 46. Thus, these posts do not prevent rear bushing installation.

To prevent the base of the rear bushing 45 from directly contacting the frame member, a thread 48 is provided. This thread is strung through the rear bushing slots in a zig-zag-pattern alternately above and below the frame projections as shown. The thread may be formed of numerous materials including silicone rubber or dental floss (preferable unused).

Figure 6:
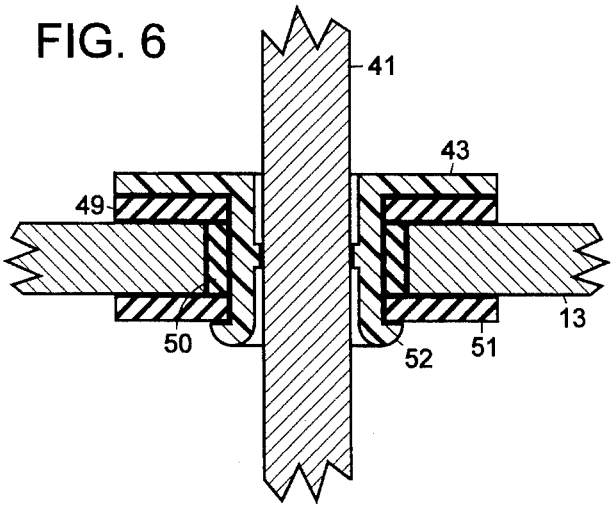
FIG. 6 is a cross-sectional view of a front guide pin, bushing, bumper parts and frame.

FIG. 6 shows a cross-sectional view of a modified bushing and bumper arrangement for the front guide pin bushings 43 & 44. The one-piece bumper shown in FIG. 9 of the applicant's prior patent is replaced here with three silicone rubber parts: a base washer 49, a bumper tube 50, and a retaining washer 51. These parts may be produced by cutting extruded tubing—an inexpensive manufacturing process compared to the molding required for the prior one-piece bumper. The diameter of the bore in each of these three parts is equal to or slightly less than the diameter of the main body of the bushing. These parts are installed by insertion of the main body of the bushing into each of their bores. The base washer 49 is installed first, followed by the bumper tube 50. Then the bushing 43 is inserted into the frame 13. To hold the bushing in the frame, the retaining washer 51 is installed. To hold the retaining washer in place, an outwardly extending retaining flange 52 is provided on the inserted end of the bushing. The diameter of this retaining flange is slightly less than the diameter of the frame bore, so the bushing can be inserted. The base and retaining washers may be identical. For faster installation, the base and/or retaining washers of a number of adjacent bushings within a row may be consolidated into a flat silicone rubber strip with punched holes (not shown).

Referring again to FIG. 4, a downstroke bumper 53 is provided, formed of extruded silicone rubber. Downstroke bumper 53 incorporates concave sides, a flat top surface with ridges 54, and a bead 55 extending downward from the bottom surface. Bead 55 fits tightly in a slot 56 in the top surface of frame member 9 (see FIG. 1). When key 39 is depressed, downstroke bumper 53 contacts the underside of key 39 halfway between the front and rear key surfaces, behind the lower-extending front section. The downstroke bumper may incorporate other cross-sectional shapes than the hourglass shape shown. It may be formed of closed-cell foam rubber or felt. Alternately, the downstroke bumper may be attached to the underside of the key instead of to the frame as shown.

Figure 7:
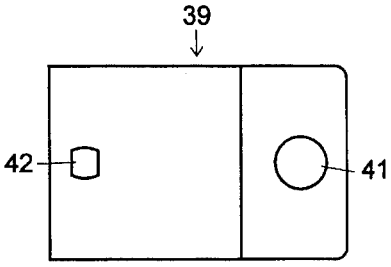
FIG. 7 is an underside view of a single key.

FIG. 7 shows a key 39 viewed from the underside. Front pin 41 has a circular cross-section. This pin may be solid, as shown, or tubular. Solid steel pins have several advantages including: (a) added strength, (b) added mass (to provide more of a "weighted action" feel to the keyboard), and (c) the annular slot 59 at the bottom of the front pin 41 may be deeper. The cross-section of rear pin 42 is rectangular with convex left and right sides.

The cross-sectional area of the front pin is greater than that of the rear pin. The following is an explanation of the reason for this difference:

When longitudinal side force is applied to the key, a bending force is placed on each guide pin. This bending force for the rear guide pin is focused at the point where the guide pin meets the underside of the key. For the front guide pin, this bending force is focused at the upper front bushing. With the key in up position, the leverage for the rear pin is only from the rear bushing to the point where the rear pin meets the underside of the key. But for the front pin, the leverage extends from the point of side force application to the upper front bushing—a greater distance. Thus, the effective bending moment is greater on the front pin than on the rear pin. Since the rear pin does not need to be as strong as the front, economy dictates a thinner, lighter rear pin with a smaller cross-sectional area. Also, a thinner rear pin allows a thinner rear bushing, which is less likely to twist and bind in between its left and right bumpers 46. Another advantage of a thinner rear bushing is that it allows more room between adjacent rear bushings for attachment of a return spring. This return spring is used in an alternate embodiment which is explained in brief later in this specification. Furthermore, a thinner rear pin allows a greater lateral distance between the bushing-engaging surfaces of two guide pins, reducing wobble.

Upper travel limit stopping means for the key are located on the bottom end of the front guide pin and contact the underside of the lower front bushing 44 at the top of key stroke.

Figure 8:
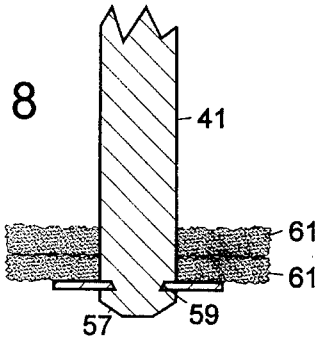
FIG. 8 is a cross-sectional view of the bottom of a front guide pin.

FIG. 8 shows one such means. At the bottom of front pin 41 is a downwardly-angled frusto-conical portion 57. Near or adjacent this portion is an annular slot. Inside this slot is another downwardly-angled frusto-conical portion 59. An E-clip 60 fits in the slot. The diameter of frusto-conical portion 59 within the annular slot is sufficiently large that E-clip 60 fits tightly and does not rattle. Above and adjacent this E-clip are one or two felt punchings 61. Off-the-shelf acoustic piano balance rail punchings may be used.

Figure 9:
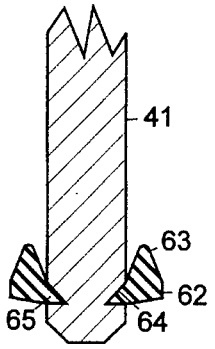
FIG. 9 is a cross-sectional view of the bottom of a front guide pin employing an alternate embodiment.
Figure 10:
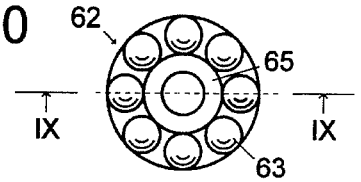
FIG. 10 is an overhead view of an upstroke bumper according to the embodiment shown in FIG. 9.

FIGS. 9 & 10 show an alternate upper travel limit stopping means. Here, a washer-shaped upstroke bumper 62 incorporating impact-absorbing cones 63 is used. These cones are positioned around the periphery of the top surface of the upstroke bumper and point upward. The outside diameter of upstroke bumper 62 is substantially equivalent to the outside diameter of the large flange of lower front bushing 44. The front pin 41 incorporates an annular slot near its bottom end with a downwardly-angled frusto-conical portion 64. The bore of the upstroke bumper incorporates an inwardly-extending retaining flange 65 which fits tightly in the front pin annular slot. Upstroke bumper 62 may be molded of silicone rubber. The inside diameter of the retaining flange 65 is large enough that it may be spread to the diameter of the front pin below the annular slot without tearing during installation.

Figure 11:
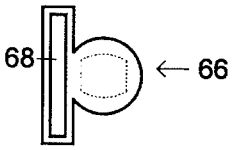
FIG. 11 is an underside view of an upper anchor for a leaf spring.

Referring again to FIG. 4, attached to the lower end of rear pin 42 is an upper leaf spring anchor 66, shown from below in FIG. 11. At the upper rear of this spring anchor is a downwardly-facing horizontal slot 68.

In the base portion of L-shaped flange 16 is a threaded bore 70. An adjustment screw 71 is provided with a knurled head 73, a threaded portion 74 with corresponding diameter and thread size to mate with bore 70, a cylindrical end portion 76, and a conical tip portion 78.

Figure 12:
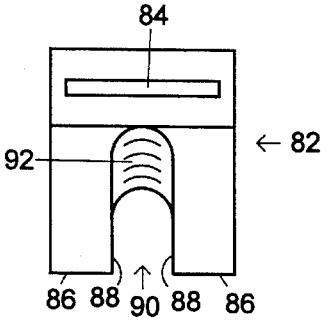
FIG. 12 is a rear view of a lower anchor for a leaf spring.

A lower leaf spring anchor 82 is provided. A rear view of lower anchor 82 is shown in FIG. 12. The top surface of lower anchor 82 includes a horizontal slot 84 which faces upward and to the rear.

A leaf spring 85 is provided. This spring may be formed of blue clock spring steel. Spring 85 is held in a buckling-deformed state with the top and bottom spring edges seated in anchor slots 68 & 84. These top and bottom spring edges are rounded to minimize wear within the anchor slots.

Extending upward from the bottom surface 86 of lower anchor 82 are two apositioned, flat, parallel, vertical surfaces 88 defining a space 90 between them. The horizontal distance between vertical surfaces 88 is substantially equivalent to the diameter of cylindrical screw portion 76. Lower anchor 82 rests in frame slot 19 with cylindrical screw portion 76 in space 90. The elevation of lower anchor 82 is adjustable by screw 71. The ceiling 92 of space 90 is arched and angled upward to the rear. This angle is substantially equivalent to the angle from horizontal of the outside surface of conical screw portion 78. With the downward force of leaf spring 85, the angle of ceiling 92 keeps lower anchor 82 wedged against frame main body portion 10 and also serves to introduce side force to screw 71. This side force increases friction within threaded bore 70 so that vibrations of the keyboard (during transport and operation) do not cause incremental unwanted turning of screw 71.

As an alternate means of preventing incremental screw turning, a coil spring (not shown) may be installed around each screw 71 between the knurled head 73 and the base portion of L-shaped flange 16. Or, a strip of nylon (not shown) may be installed which runs the length of each row in place of the coil springs. A hole is provided in the nylon strip for each screw 71. Each screw is screwed into its corresponding hole before being screwed into its corresponding threaded bore 70 in the frame. The holes in the nylon strip have a diameter smaller than the outside diameter of the threaded screw portions 74. Thus, the nylon clamps tightly around each screw in a manner similar to Ny-Loc aircraft nuts. With this coil spring or nylon strip, the top end of screw 71 may be flat (not shown) and the ceiling of space 90 may be flat and horizontal (not shown).

The height of space 90 at center is slightly less than the combined length of cylindrical screw portion 76 and conical screw portion 78 so that threaded screw portion 74 does not contact lower anchor 82. Leaf spring anchors 66 & 82 may be formed of nylon or similar material.

A piezoelectric sensor 93 is provided. Recommended sensor 93 is Kynar®Piezo Film of 52 microns thickness manufactured by Atochem Sensors, Inc. The length of sensor 93 includes three portions: an affixed portion 94, a connector portion 95, and an electrode portion 96. Affixed portion 94 is laminally attached to the front surface of leaf spring 85. To bond the sensor to the leaf spring, a pressure-sensitive acrylic adhesive may be used. Scotch™ brand Double Coated Tape #444, manufactured by 3M Industrial Specialties Division is recommended. Areas at the top and bottom of the front surface of leaf spring 85 are left exposed without sensor 93 attached.

Sensor connector portion 95 bends forward and upward from leaf spring 85 to a circuit board 97 which is mounted on frame member main body portion 10. Sensor electrode portion 96 is affixed to the front surface of circuit board 97 with Scotch™ brand Electrically Conductive Adhesive Transfer Tape #9703, manufactured by 3M Industrial Specialties Division. Electric current generated by leaf spring movement passes through electrical contacts in sensor electrode portion 96, electrically conductive tape, and electrical contacts on the front surface of circuit board 97. Processing circuits in circuit board 97 measure this current.

A foam rubber pad 98 positioned between frame member main body portion 10 and sensor electrode portion 96 assists the electrically conductive tape in keeping the sensor electrode portion affixed to the circuit board.

An alternate method of providing key return and key motion is shown in FIG. 13. This method uses a swing arm 105 under the rear guide pin 42 which is pulled upward by a coil spring 110. The top end of the coil spring is attached to the rear flange 12 between two rear bushings 45. The bottom end is hooked in a slot 115 in the swing arm 105 between the swing arm pivot 120 and the free end 122 of the swing arm. The free end of the swing arm is turned upward and pointed and pushes upward on the concave bottom end 125 of a push rod 130. The top end 135 of the push rod pushes on the bottom end of the rear guide pin 42 via a bushing 140. The bushing is attached to the bottom end of the rear guide pin and has a concave underside. The free end 122 of the swing arm at the point of push rod contact remains above horizontal with the swing arm pivot 120 during operation. The slot 115 on the swing arm where the coil spring 110 makes contact remains below horizontal with the pivot during operation. These contact points are positioned so that the increasing force which the spring exerts as it is pulled downward is counteracted by the shifting positions (and shifting leverages) of the contact points. Thus, decreasing downstroke resistance is achieved. Extending upward from the swing arm on the other side of the pivot is a contact spring arm 145. One end of a contact spring 150 is attached to this arm and the other to a metal post 155 on a circuit board 160. The contact spring swings with key movement and alternates contact with two metal contact posts 165. A microprocessor measures circuit openings and closures between the contact spring and the two contact posts. This key motion sensing system is similar to that used in the keyboard made by Fatar Co. for the Ensoniq SDP-1.

I claim:

1. In a keyboard for a finger-operated device, a key, a front guide pin, a rear guide pin, a frame member, said guide pins extending downward directly from the underside of said key, the improvement comprising, an upper front bushing, a lower front bushing, and a rear bushing, wherein, said bushings are incorporated in said frame member, said front guide pin mates with said front bushings and said rear guide pin mates with said rear bushing.

2. A keyboard as in claim 1 wherein the front bushings accommodate 360 degrees of side force and the rear bushing substantially provides no resistance to lateral side force.

3. A keyboard as in claim 1 wherein said front guide pin has greater cross-sectional area than said rear guide pin.

4. A keyboard as in claim 1 wherein the cross-section of said rear guide pin is rectangular with convex left and right sides.

5. A keyboard as in claim 1 wherein the underside surface of said key adjacent the front guide pin is lower than the underside surface of said key adjacent the rear guide pin.

6. A keyboard as in claim 1 incorporating upper travel limit stopping means on the bottom end of said front guide pin.

7. A keyboard as in claim 1 incorporating lower travel limit stopping means on the top surface of said frame member between said rear bushing and said upper front bushing.

8. A keyboard as in claim 7 wherein the contacting surface on the key for the lower travel limit stopping means is closer to the key top than the underside key surface adjacent the front guide pin.

9. A keyboard as in claim 1 incorporating a plurality of key rows wherein at least two of said rows are terraced.

10. A keyboard as in claim 9 wherein said rear bushing is the same elevation as the front uppermost bushing of the key adjacent to the rear.

11. A keyboard as in claim 1 incorporating a plurality of key rows wherein the keys of at least one row comprise a whole tone scale.

12. A keyboard as in claim 11 wherein the keys which normally sound notes corresponding to the black keys of a standard keyboard incorporate black tops and white sides.

13. A keyboard as in claim 1 incorporating a plurality of frame members as in claim 1 wherein, the rear of at least one of said frame members engages the front of at least one other of said frame members.

14. A keyboard as in claim 13 further incorporating a bundling system wherein, said engaged frame members are engaged via a tongue & groove joint and are held in lateral position relative to each other by said bundling system.

15. A keyboard as in claim 13 wherein, said engaged frame members are engaged via an interlocking tongue & groove joint.

* * * * *